US009915922B2

(12) United States Patent
Stranczl

(10) Patent No.: US 9,915,922 B2
(45) Date of Patent: Mar. 13, 2018

(54) CONTACTLESS CYLINDER ESCAPEMENT

(71) Applicant: Nivarox-FAR S.A., Le Locle (CH)

(72) Inventor: Marc Stranczl, Nyon (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 15/286,022

(22) Filed: Oct. 5, 2016

(65) Prior Publication Data

US 2017/0168454 A1 Jun. 15, 2017

(30) Foreign Application Priority Data

Dec. 10, 2015 (EP) ..... 15199338

(51) Int. Cl.

| | |
|---|---|
| ***G04C 5/00*** | (2006.01) |
| ***G04B 15/04*** | (2006.01) |
| ***G04B 15/14*** | (2006.01) |
| ***G04C 3/10*** | (2006.01) |

(52) U.S. Cl.

CPC ..... *G04B 15/04* (2013.01); *G04B 15/14* (2013.01); *G04C 3/10* (2013.01); *G04C 3/105* (2013.01); *G04C 5/00* (2013.01); *G04C 5/005* (2013.01)

(58) Field of Classification Search

CPC ..... G04B 15/04; G04B 15/14; G04C 3/10; G04C 3/105; G04C 5/00; G04C 5/005

See application file for complete search history.

(56) References Cited

U.S. PATENT DOCUMENTS 3,183,426 A * 5/1965 Haydon ..... G04C 5/005 368/132
3,410,083 A * 11/1968 Korr ..... G04C 5/005 368/126

(Continued)

FOREIGN PATENT DOCUMENTS

| | | | |
|---|---|---|---|
| CH | 709 019 A2 | 6/2015 | |
| DE | 873822 C * | 4/1953 | ..... G04C 5/005 |
| FR | 2233738 A1 * | 1/1975 | ..... G04C 3/061 |

(Continued)

OTHER PUBLICATIONS

European Search Report dated Jun. 8, 2016 in European Application 15199338.3 dated Dec. 10, 2015 (with English Translation of Categories of cited documents).

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

Magnetic cylinder escapement, comprising a regulating wheel set cooperating with an escape wheel comprising actuators (6) at the periphery of a first disc, each comprising a first impulse part and a second stop part, generating or guiding magnetic fields parallel to the pivot axes, and arranged to work in attraction, via the first disc, with a second non-magnetically charged, soft ferromagnetic disc integral with the regulating wheel set, the mechanism comprising a conductive ferromagnetic plate, underneath but not in contact with the first disc, comprising a cutout surrounding, in a contactless manner, the periphery of the second disc, with a variable air-gap, and closing a magnetic circuit comprising an actuator, the first disc, the second disc, and a structure in which the escape wheel pivots and which carries the plate.

9 Claims, 8 Drawing Sheets

(56) References Cited

U.S. PATENT DOCUMENTS

| | | | | |
|---|---|---|---|---|
| 3,690,191 | A * | 9/1972 | Hans Ott | F16H 31/00 310/21 |
| 2017/0003653 | A1 * | 1/2017 | Stranczl | G04C 5/005 |

FOREIGN PATENT DOCUMENTS

| | | | | |
|---|---|---|---|---|
| GB | 671360 | | 5/1952 | |
| GB | 671360 | A * | 5/1952 | G04C 5/005 |
| WO | WO 2015/096973 | A2 | 7/2015 | |
| WO | WO 2015096973 | A2 * | 7/2015 | G04C 5/005 |

* cited by examiner

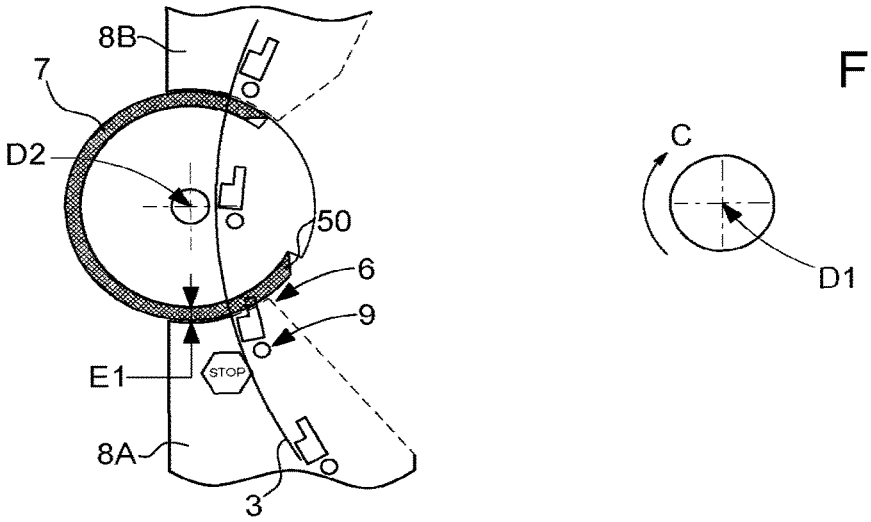
Fig. 22
Fig. 23
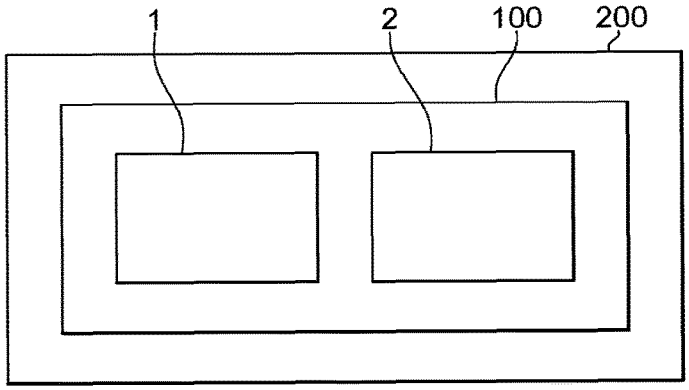

CONTACTLESS CYLINDER ESCAPEMENT

This application claims priority from European Patent Application No. 15199338.3 filed on Dec. 10, 2015, the entire disclosure of which is hereby incorporated herein by reference.

FIELD OF THE INVENTION

The invention concerns a timepiece escapement mechanism, arranged to cooperate with means for supplying torque, and comprising a regulator wheel set cooperating with an escape wheel.

The invention also concerns a timepiece movement including such an escapement mechanism.

The invention also concerns a watch including at least one movement of this type.

The invention concerns the field of timepiece escapement mechanisms, and more specifically the field of contactless escapement mechanisms.

BACKGROUND OF THE INVENTION

The invention concerns a cylinder escapement mechanism.

WO Patent Application 2015/096973 A2 in the name of Nivarox-FAR S.A., describes a magnetic cylinder escapement, wherein a circular magnet is integral with the regulating member. It is, however, difficult to produce a perfectly circular magnet concentric with the sprung balance. Moreover, this magnetic element on the sprung balance is sensitive to external fields, which may therefore interfere with the operation of the watch.

SUMMARY OF THE INVENTION

The invention proposes to improve the magnetic cylinder escapement of the same inventor, by reducing its sensitivity to external magnetic fields, and by making it simpler and less expensive to produce.

To this end, the invention concerns a timepiece escapement mechanism according to claim 1.

The invention also concerns a timepiece movement including such an escapement mechanism.

The invention also concerns a watch including at least one movement of this type.

BRIEF DESCRIPTION OF THE DRAWINGS

Other features and advantages of the invention will appear upon reading the following detailed description, with reference to the annexed drawings, in which:

FIG. 23 is a block diagram representing a watch including a timepiece movement which in turn includes an escapement mechanism of this type.

DETAILED DESCRIPTION OF PREFERRED EMBODIMENTS

The invention concerns the field of timepiece escapement mechanisms, and more specifically the field of contactless escapement mechanisms.

Mechanical cylinder escapements have the advantage of ensuring safety in the event of excessive torque, notably in the event of a shock, but their high friction level significantly impairs the efficiency of the escapement.

The present invention uses the same operating sequences as international Patent Application WO 2015/096973 A2, which is based on a magnetic repulsion system, but is based instead on a magnetic attraction system.

The "elementary building block" principle, based on magnetic attraction, is illustrated in FIGS. 1 to 4.

Figure 1:
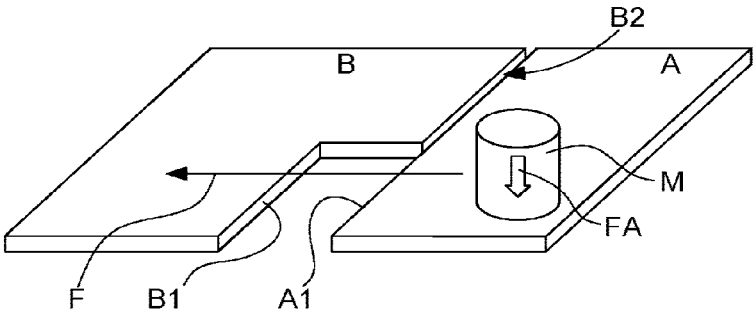
FIGS. 1 to 4 are schematic perspective views of the elements forming an elementary building block, and illustrating the principle of the invention.

FIG. 1 shows a cylindrical magnet M, above two metal plates A and B. Magnet M is attracted by a magnetic attraction force FA to the metal plate A on which it rests.

This magnet is pushed from right to left, i.e. from plate A towards plate B, by an external force that is not illustrated; arrow F illustrates the path that magnet M would take.

Figure 2:
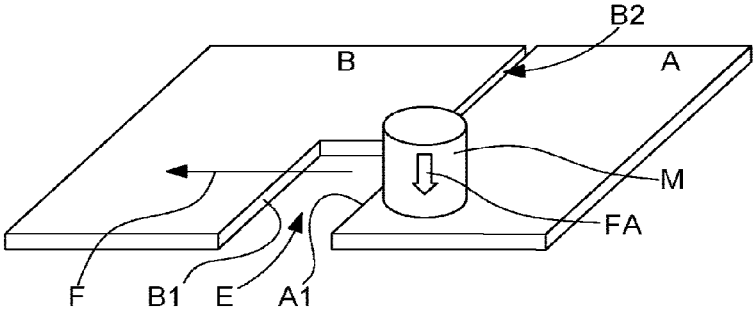

Under the action of this external force, magnet M slides and moves closer to the edge A1 of plate A, as seen in FIG. 2. It will not go any further since there is an intermediate space E that is too wide between edge A1 of plate A and a first edge B1 of plate B: magnet M sees a "void" and, since it is attracted to plate A, it does not cross the void of intermediate space E.

Figure 3:
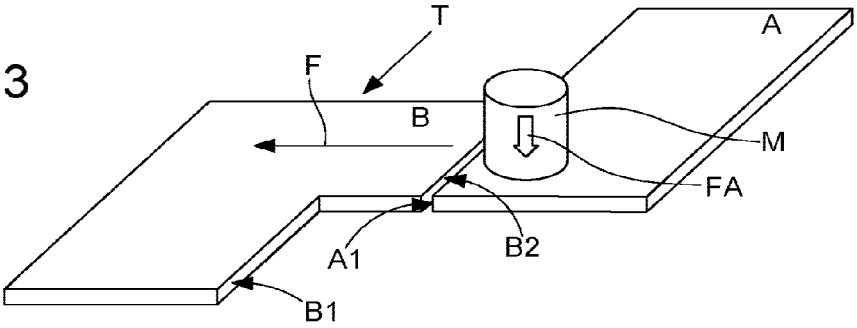

If plate B is moved by a movement T, tending to replace first edge B1 of plate B with a second edge B2, closer to plate A, as seen in FIG. 3, the space between the two plates A and B is greatly reduced, from the point of view of magnet M.

Magnet M no longer sees the "void" and can therefore continue a right-to-left movement, from plate A towards plate B, crossing the reduced residual space ER.

Figure 4:
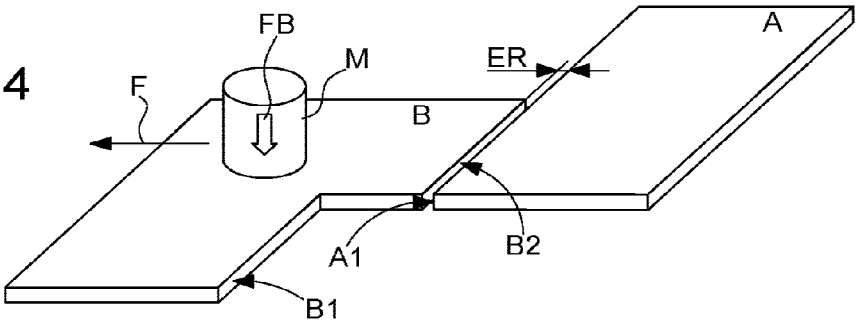

FIG. 4 shows magnet M above plate B, towards which it is drawn by a magnetic attraction force FB.

The invention concerns a timepiece escapement mechanism 1, which is arranged to cooperate with means for providing torque, notably drive motor means 2, such as a barrel or similar.

Escapement mechanism 1 includes a regulator wheel set 5 cooperating with an escape wheel 3.

According to the invention, escapement mechanism 1 is a magnetic cylinder escapement. Escape wheel 3 includes actuators 6 at the periphery of a first disc 30. In a particular embodiment of the invention, the first disc 30 is made of soft ferromagnetic material.

Each of actuators 6 includes a first impulse part 61 and a second stop part 62. Actuators 6 consist of magnetic portions, which may be made in two ways:

- with a magnet;
- or as guides for magnetic fields from magnets disposed in an area that consists of the space available for this purpose, for example close to the axis of rotation of the escape wheel, these fields thus being guided wherever the actuator is desired to be.

These first impulse parts 61 and second parts 62 are thus magnetically charged, or ferromagnetic conductors of a magnetic field, and are arranged to each guide a magnetic field parallel to the pivot axes, and arranged to work in attraction, through first disc 30, with a second soft ferromagnetic disc 7, which is not magnetically charged, integral with regulator wheel set 5.

These first and second parts 61 and 62 are referred to as first magnetic part 61 and second magnetic part 62 in the following description, regardless of their embodiment.

Mechanism 1 comprises a conductive ferromagnetic plate 8, underneath first disc 30 and not in contact therewith, comprising a cutout 80 surrounding periphery 70 of second disc 7 in a contactless manner with a variable air-gap E. Plate 8 closes a magnetic circuit comprising an actuator 6, first disc 30, second disc 7 and a structure 34, in which escape wheel 3 pivots, and which carries plate 8.

More particularly, escapement mechanism 1 includes at least one escape wheel 3, which is subjected to a rotational torque, whose moment is lower than or equal to a nominal moment, about a first pivot axis D1, under the action of such means for providing torque.

This escapement mechanism 1 comprises a regulating member or resonator 4 integral with a regulating wheel set 5, preferably mounted to pivot about a second real or virtual pivot axis D2. This regulating member or resonator 4 is notably of the sprung balance type or similar.

Figure 5:
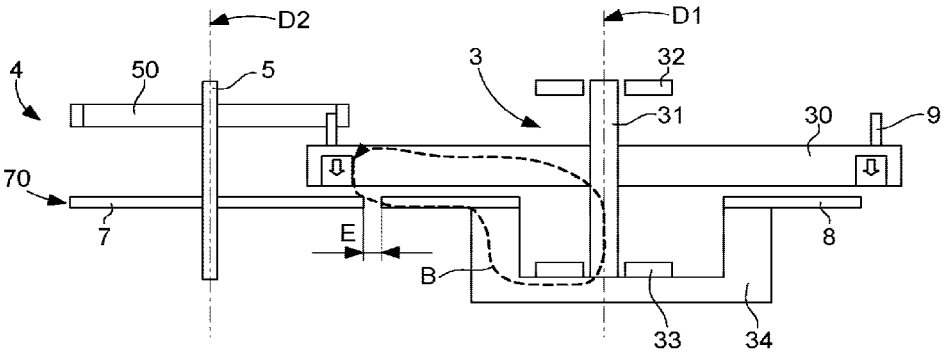
FIGS. 5 and 6 illustrate, in cross-section and in perspective, a timepiece escapement mechanism according to the invention, built on this principle.
Figure 6:
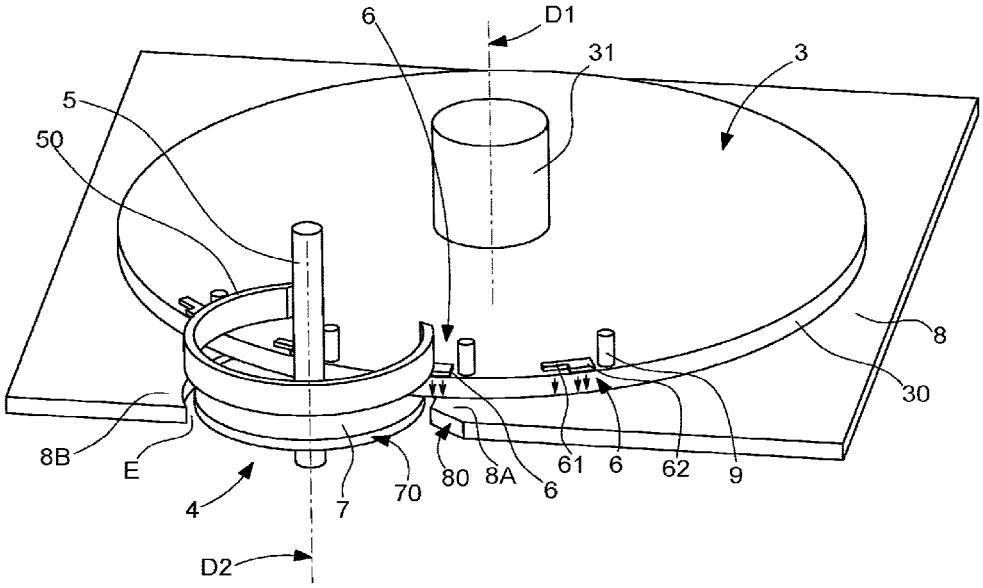

According to the invention, escapement mechanism 1 forms a magnetic cylinder escapement, and, as seen in FIGS. 5 and 6, escape wheel 3 includes a plurality of such actuators 6, which are regularly spaced around the periphery of a first disc 30, which, in a particular but non-limiting manner, is a soft ferromagnetic magnetic field conductor, pivoting integrally with escape wheel 3. Each of these actuators 6 includes magnetic parts, and is arranged to work in attraction, through first disc 30, with at least a second disc 7 comprised in regulating wheel set 5, and pivoting integrally therewith.

This second disc 7 is soft ferromagnetic but not magnetically charged.

Preferably, in the non-limiting embodiment illustrated by the Figures, each actuator 6 includes at least: a first magnetic part 61, called the impulse magnet, and a second magnetic part 62, called the stop magnet, which generate or guide magnetic fields of substantially the same direction and of the same sense, substantially parallel to the first pivot axis D1 of escape wheel 3.

More particularly, these actuators 6 also include mechanical stops 9. First magnetic part 61, second magnetic part 62 and mechanical stop member 9 follow each other, on a substantially equal radius with respect to first pivot axis D1.

Substantially in the same plane as second disc 7, escapement mechanism 1 includes a conductive ferromagnetic plate 8, disposed underneath first disc 30, and having no contact therewith. Preferably, plate 8 includes a cutout 80 which surrounds, in a contactless manner, the periphery 70 of second disc 7, so as to provide an air-gap between plate 8 and second disc 7.

Escape wheel 3 includes a shaft-like portion 31, pivoting in bearings 32 and 33 of a structure 34. The relative arrangement of first disc 30, actuators 6, second disc 7, plate 8 and structure 34 is such that the magnetic circuit can be closed in a loop, schematically represented in dash lines with the reference B in FIG. 5.

When actuators 6 comprise mechanical stops 9, regulator wheel set 5 includes a truncated non-ferromagnetic crown, which forms a complementary mechanical stop.

According to the invention, second disc 7 comprises a first peripheral area 71 defining, with plate 8, a first air-gap E1 greater than a second air-gap E2 existing between plate 8 and a second peripheral area 72 adjacent to first area 71. Actuators 6 and first air-gap E1, and second air-gap E2, are dimensioned such that a first magnetic part 61 can only cross second air-gap E2, and is blocked by first air-gap E1, in accordance with the elementary building brick principle, explained above.

More particularly, and as seen in the non-limiting embodiment of the Figures, first area 71 is a cylindrical sector of first radius R1 about second pivot axis D2, which is coaxial with second area 72, which is a cylindrical sector of second radius R2.

Preferably but not restrictively, truncated crown 50 is superposed with first area 71 and its opening corresponds to second area 72.

Regulating member 4 is devoid of magnets.

The kinematics are illustrated by the simplified FIGS. 7 to 21, which do not represent either the balance or the balance spring, but only those components directly working with escape wheel 3.

Figure 7:
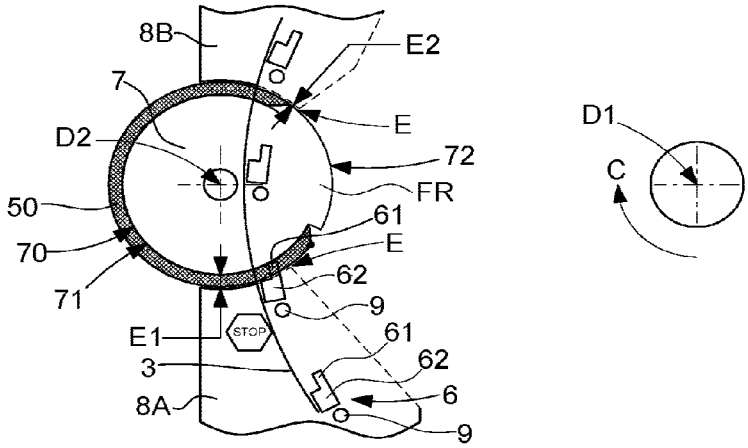
FIGS. 7 to 21 represent the various successive operating steps, while FIG. 22 concerns the case of application of an excessively high torque, for example in the event of a shock, and the role of the mechanical stops comprised in the mechanism according to the invention.

In FIG. 7, the state of the system is as follows: escape wheel 3, subjected to the torque transmitted by the barrel, would rotate in the clockwise direction, but is stopped here. The balance is also rotating in the clockwise direction under the return action of the balance spring.

First magnetic impulse part 61 of a first actuator 6 appears opposite first area 71 of second disc 7, at a first air-gap E1, since it is forced by escape wheel 3 to exit an upstream portion 8A of ferromagnetic plate 8.

The largest part of the same first actuator 6, forming second magnetic stop part 62, has a stronger magnetic force and does not exit ferromagnetic plate 8.

In this position, first magnetic impulse part 61 is at the widest first air-gap E1, which it has penetrated, and second magnetic stop part 62 does not pass. The actuator 6 concerned is thus stopped at the edge of air-gap E.

Figure 8:
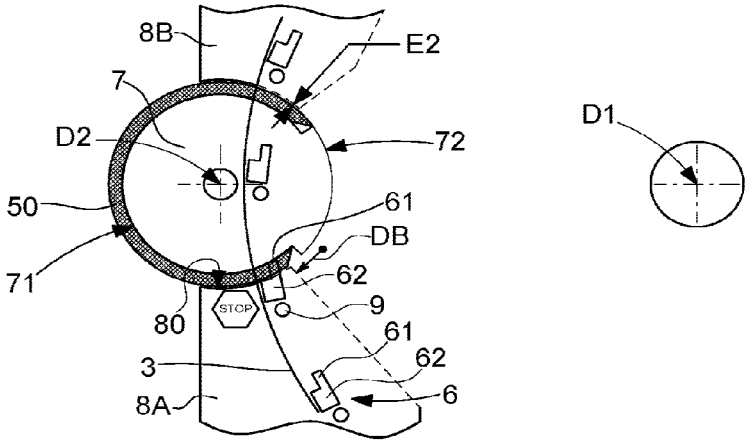

FIG. 8 illustrates the start of the time impulse: the balance passes through the neutral point, where the return torque of the balance spring is zero, and first magnetic impulse part 61 will start to apply an impulse to the balance through the magnetic attraction of second disc 7. Escape wheel 3 is still stopped. The clockwise movement of the balance is illustrated by arrow DB. It is seen that second area 72 of second disc 71 moves closer to first magnetic impulse part 61.

Figure 9:
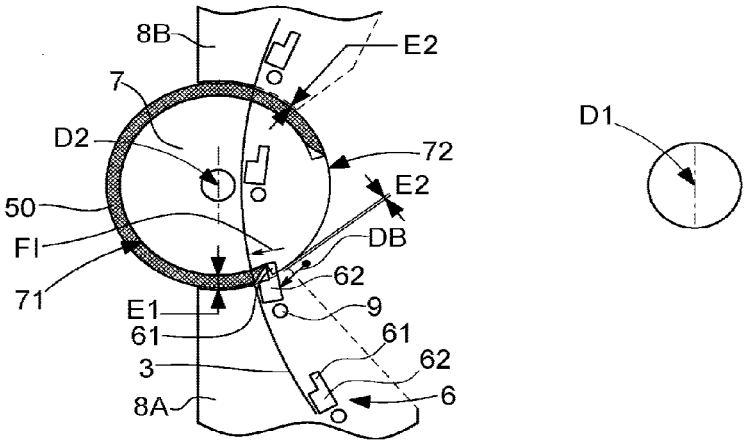

FIG. 9 shows the end of the time impulse: first magnetic impulse part 61 attracts the balance and closes the air-gap by cooperating with second area 72 and second air-gap E2, and thus opens up the path for second magnetic stop part 62, which can cross second air-gap E 2. Escape wheel 3 is still stopped, but will therefore start to rotate in the clockwise direction.

The impulse F1 through magnetic attraction is similar to a constant force.

In each of the Figures, the arrows DB and F indicate the path already covered by the balance and the escape wheel respectively.

Figure 10:
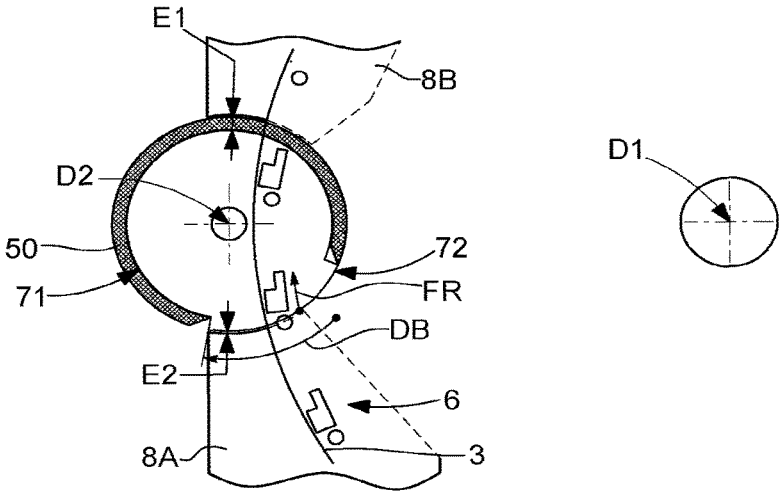

FIG. 10 illustrates the start of the vibration of the balance and the rotation of the escape wheel: the balance rotates and the effect of the impulse, and escape wheel 3 moves forward. First actuator 6, which has crossed air-gap E, is now superposed on second disc 70, while a second actuator 6, which was previously superposed on second disc 6, now appears close to air-gap E, but between second disc 7 and a downstream portion 8B of ferromagnetic plate 8.

Figure 11:
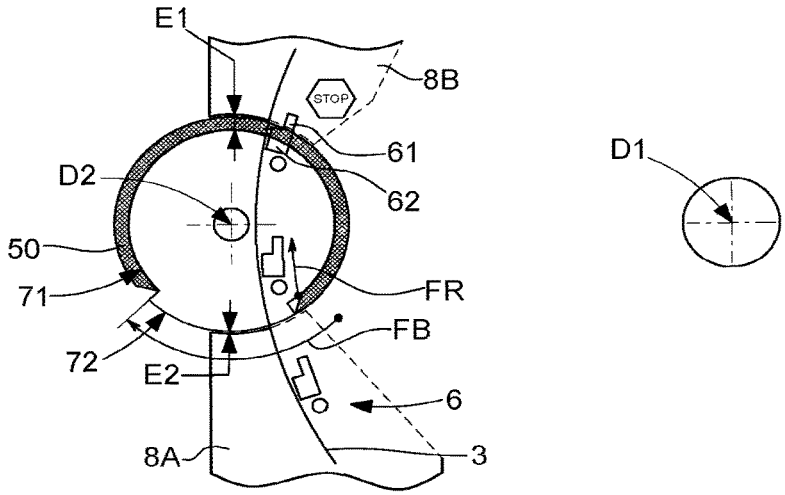

FIG. 11 shows the rotation of the balance under the effect of the impulse, and escape wheel 3 which is stopped by second magnetic stop part 62 of second actuator 6 inside crown 50, with first magnetic impulse part 61 of this actuator 8 covering first air-gap E1 on the side of downstream portion 8B. It is understood that each actuator 6 plays a similar part to that of an escape wheel tooth in a conventional mechanical escapement.

Figure 12:
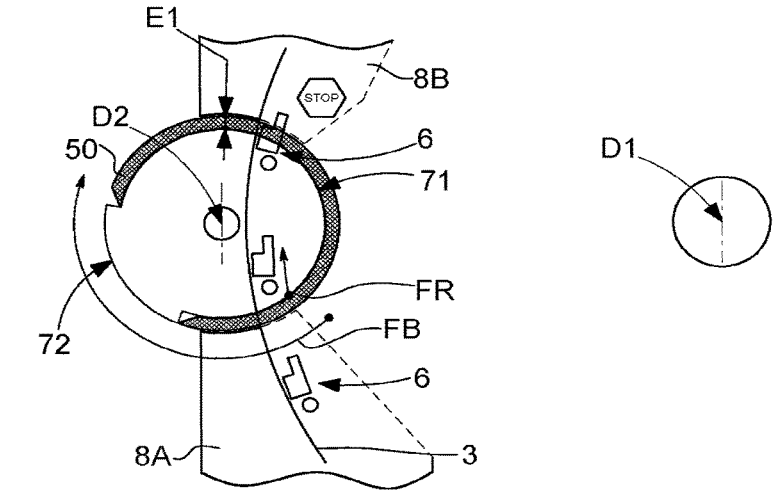

FIG. 12 corresponds to the maximum amplitude of the balance, with escape wheel 3 still stopped.

Figure 13:
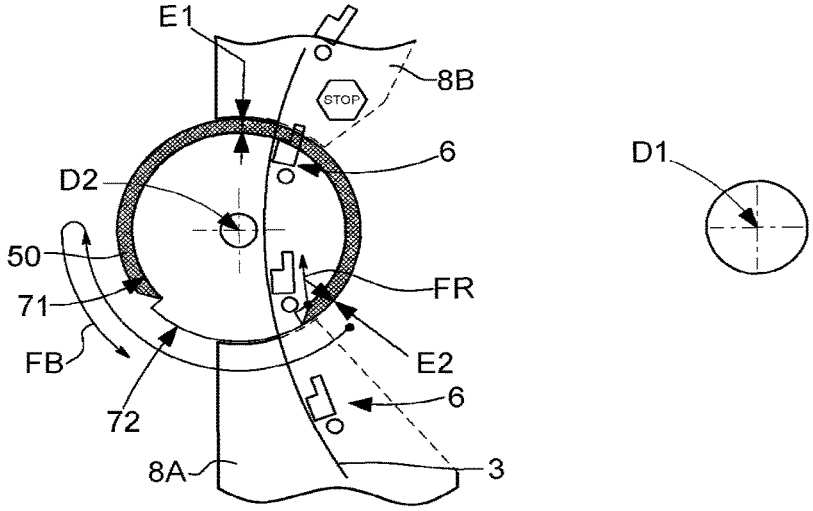

FIG. 13 shows the anti-clockwise rotation of the balance, with the escape wheel still stopped.

Figure 14:
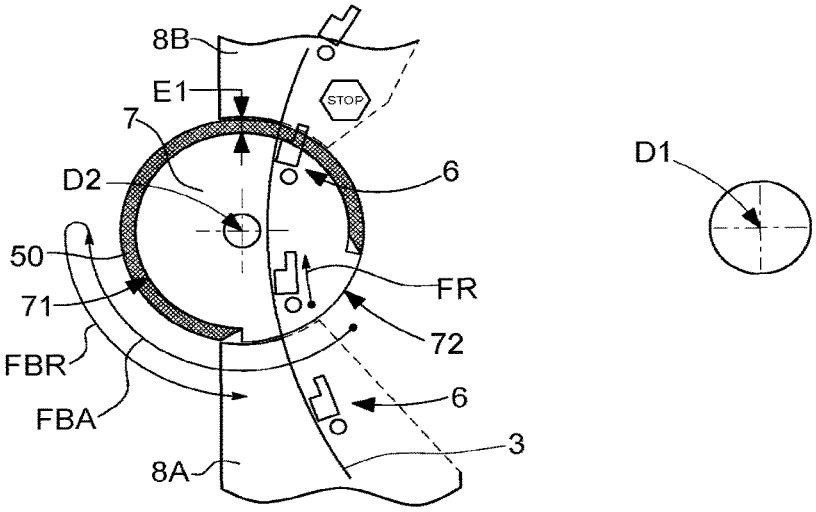

FIG. 14 shows the continued anti-clockwise rotation of the balance, which tends to move second area 72 of second disc 7 closer to second actuator 6, which is still waiting to cross towards downstream portion 8B.

Figure 15:
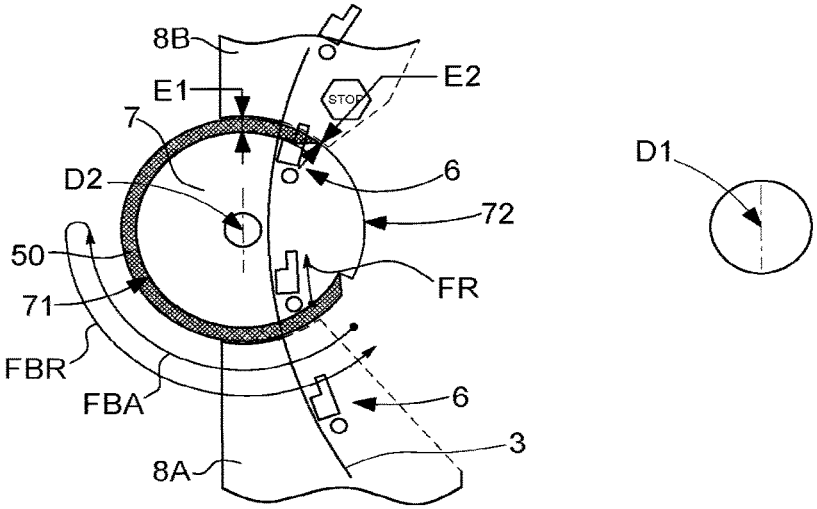

FIG. 15 shows the situation at the moment before the start of the impulse, where second area 72 of second disc 7 arrives at first magnetic impulse part 61 of second actuator 6. The escape wheel is still stopped.

Figure 16:
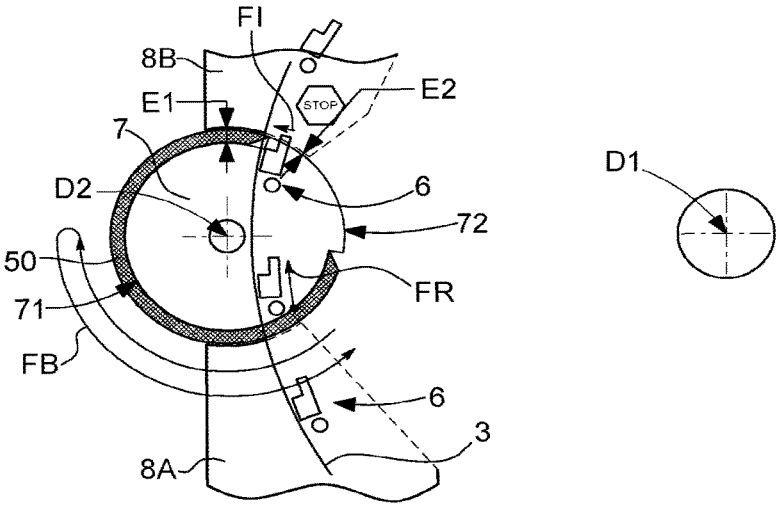

FIG. 16 shows the end of the impulse imparted by first magnetic impulse part 61 of second actuator 6. Escape wheel 3 starts to rotate.

Figure 17:
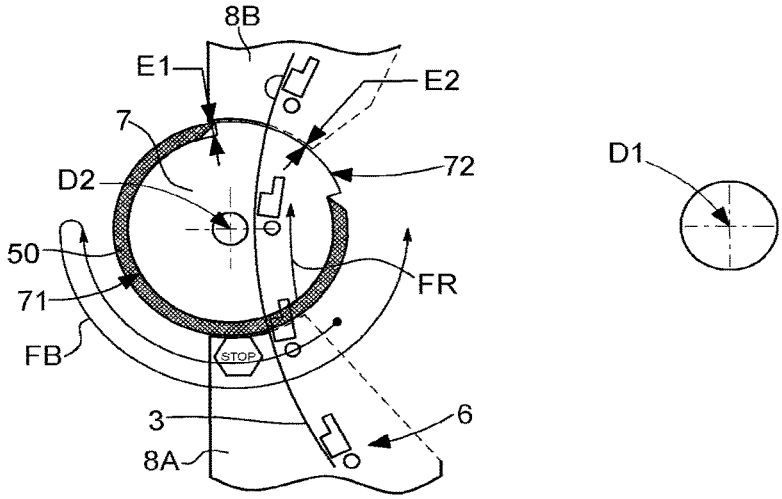

FIG. 17 shows escape wheel 3 which is stopped, after having turned. Second actuator 6 has crossed the passage between second disc 7 and downstream portion 8B, above which it is now located, and a third actuator 6 appears at the interface between upstream portion 8A and second disc 7, and is stopped, only its first magnetic impulse part 61 being above air-gap E 1, whereas its second magnetic stop part 62 cannot pass.

Figure 18:
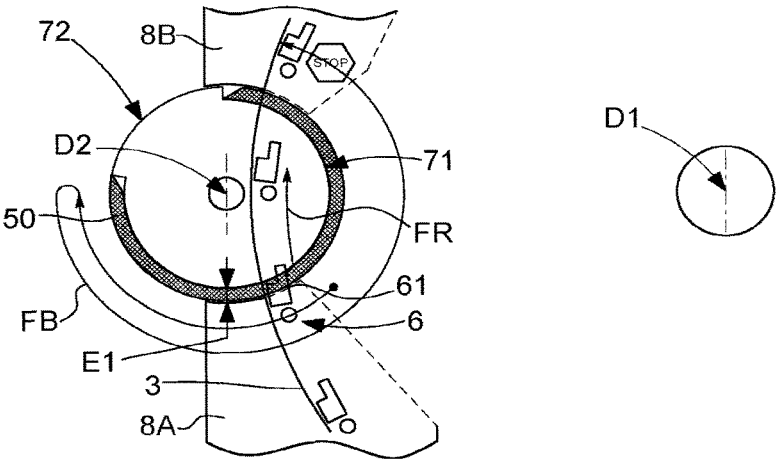

FIG. 18 illustrates the end of the anti-clockwise rotation of the balance, with escape wheel 3 still stopped.

Figure 19:
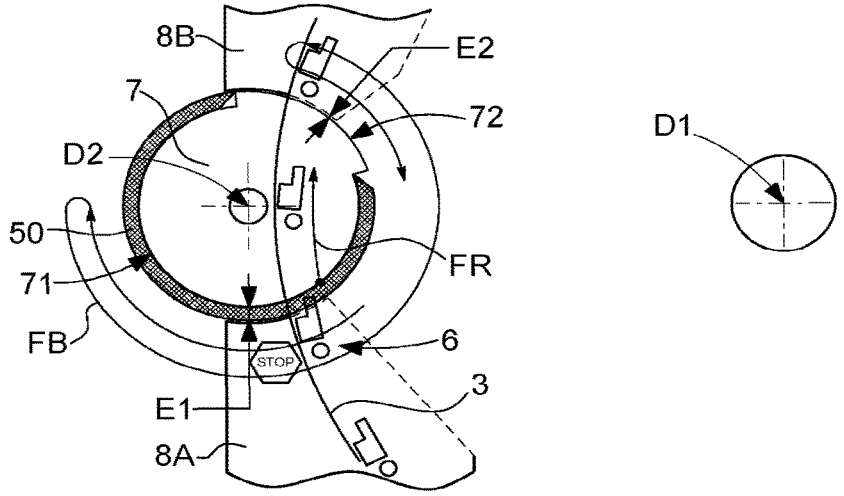

FIG. 19 shows the clockwise rotation of the balance after the reversal of direction, the escape wheel is still stopped, blocked by third actuator 6.

Figure 20:
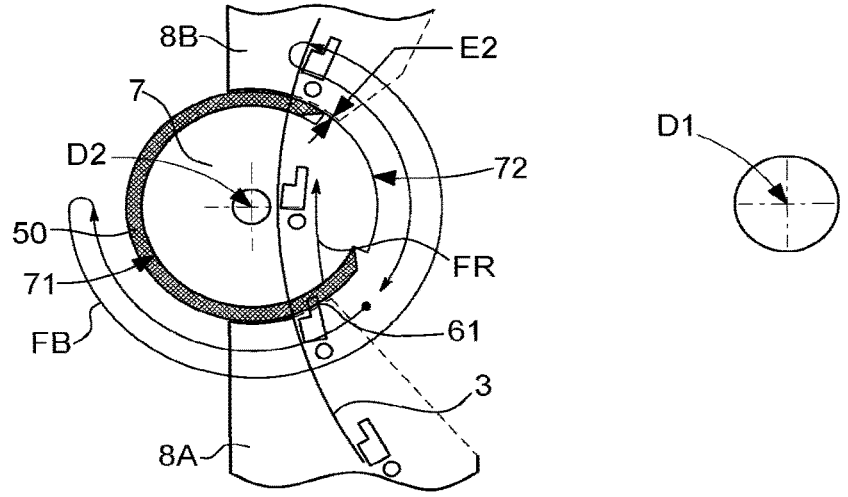

FIG. 20 shows the continued clockwise rotation of the balance, second area 72 is moving closer to third actuator 6, and escape wheel 3 is stopped.

Figure 21:
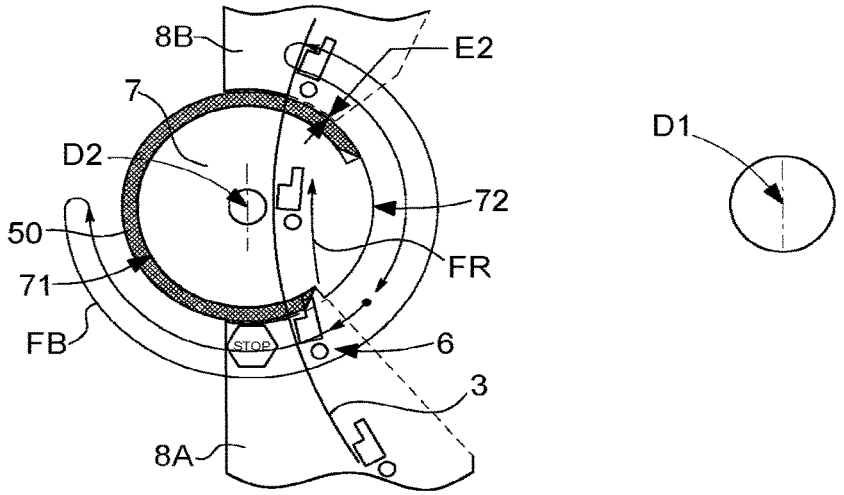

FIG. 21 shows the start of the time impulse imparted by first magnetic impulse part 61 of third actuator 6. The escape wheel is again stopped.

The cycle continues by returning to FIG. 7.

It is clear that, in this very schematic representation, the impulses are not given exactly for the same angular position of the plate, those skilled in the art know how to make a suitable path for the escapement to bring them into synchronisation.

In the event of an excessively high torque, FIG. 22 shows the role of mechanical stops 9 and complementary stop 50, absorbing the torque imparted to the escape wheel.

The invention also concerns a timepiece movement 100 including such an escapement mechanism.

The invention also concerns a watch 200 including at least one movement 100 of this type.

The cylinder escapement using magnetic attraction according to the invention represents progress relative the cylinder escapement using magnetic repulsion, since it is less sensitive to external magnetic fields and is simpler to produce.

What is claimed is:

1. A timepiece escapement mechanism, arranged to cooperate with means for providing torque and comprising at least one escape wheel, which is subjected to a rotational torque, whose moment is lower than or equal to a nominal moment, about a first pivot axis, under the action of said means for providing torque, and comprising a regulating member integral with a regulating wheel set mounted to pivot about a second pivot axis, wherein said escapement mechanism constitutes a magnetic cylinder escapement, and in that said escape wheel comprises a plurality of actuators, regularly spaced around the periphery of a first disc, pivoting integrally with said escape wheel, said actuators each comprising magnetically charged or ferromagnetic magnetic field conductor parts, and each being arranged to work in attraction, via said first disc, with at least a second disc comprised in said regulating wheel set and pivoting integrally therewith, said second disc being soft ferromagnetic and not magnetically charged, each said actuator including at least: a first magnetic impulse part, and a second magnetic stop part, which generate or guide magnetic fields of substantially the same direction and the same sense, substantially parallel to said first pivot axis of said escape wheel, and in that said escape mechanism comprises, substantially in the same plane as said second disc, a conductive ferromagnetic plate, disposed underneath said first disc and not in contact therewith, said plate comprising a cutout which surrounds, in a contactless manner, the periphery of said second disc, so as to provide a variable air-gap between said plate and said second disc, and said plate being arranged to ensure the closing of the magnetic circuit formed by at least one said actuator, said first disc, said second disc, and a structure in which said escape wheel pivots and which carries said plate, and wherein said second disc comprises a first peripheral area defining with said plate a first air-gap greater than a second air-gap that exists between said plate and a second peripheral area adjacent to said first area, and in that said actuators and said first air-gap and said second air-gap are dimensioned such that a said first magnetic part can only cross said second air-gap and is blocked by said first air-gap.

2. The escapement mechanism according to claim 1, wherein said first area is a cylindrical sector having a first radius about said second pivot axis coaxial with said second area, which is a cylindrical sector having a second radius.

3. The escapement mechanism according to claim 1, wherein, following said first magnetic impulse part and said second magnetic stop part, each said actuator comprises a mechanical stop, arranged to cooperate, in the event of an excessively high torque, with a non-ferromagnetic truncated crown, comprised in said regulating wheel set, and which forms a complementary mechanical stop.

4. The escapement mechanism according to claim 3, wherein said truncated crown is superposed on said first area, and in that the opening thereof corresponds to said second area.

5. The escapement mechanism according to claim 3, wherein said first magnetic impulse part, said second magnetic stop part and said mechanical stop are arranged one after the other, on a substantially equal radius with respect to the first pivot axis.

6. The escapement mechanism according to claim 1, wherein said regulating member is devoid of magnets.

7. The escapement mechanism according to claim 1, wherein said disc is made of soft ferromagnetic material.

8. A timepiece movement including an escapement mechanism according to claim 1.

9. A watch including at least one movement according to claim 8.

* * * * *